US005857846A

United States Patent [19]

Sattelmayer et al.

[11] Patent Number: 5,857,846

[45] Date of Patent: Jan. 12, 1999

[54] BURNER

[75] Inventors: Thomas Sattelmayer, Mandach, Switzerland; Martin Valk, Munich, Germany

[73] Assignee: ABB Research Ltd., Zurich, Switzerland

[21] Appl. No.: 839,645

[22] Filed: Apr. 15, 1997

[30] Foreign Application Priority Data

May 6, 1996 [DE] Germany ..... 196 18 058.9

[51] Int. Cl.[6] ..... F23D 17/00

[52] U.S. Cl. ..... 431/284; 431/183; 431/187; 431/278

[58] Field of Search ..... 431/8, 9, 10, 278, 431/284, 349, 182, 187, 183, 184, 185

[56] References Cited

U.S. PATENT DOCUMENTS

| | | | |
|---|---|---|---|
| 3,349,826 | 10/1967 | Poole et al. | 431/183 |
| 4,838,783 | 6/1989 | Fuglistaller et al. | 431/284 |
| 5,101,633 | 4/1992 | Keller et al. | 431/183 |
| 5,407,347 | 4/1995 | Bortz | 431/183 |

FOREIGN PATENT DOCUMENTS

| | | |
|---|---|---|
| 0108361 | 5/1984 | European Pat. Off. . |
| 1451393 | 3/1969 | Germany . |
| 1138601 | 2/1985 | U.S.S.R. . |

*Primary Examiner*—Carl D. Price

*Attorney, Agent, or Firm*—Burns, Doane, Swecker & Mathis, L.L.P.

[57] ABSTRACT

In a burner (1) for a heat generator, having a throughflow passage (3) for the throughflow of a combustion-air flow (12), a hentral main fuel lance (5) acts inside the said throughflow passage (3). A number of mixing elements (6) are arranged in an annular manner around this main fuel lance (5), and the remaining annular throughflow cross section is covered concentrically hereto by swirl generators. The mixing elements (6) are fed with a fuel (13*a*) and a partial combustion-air quantity (12*a*). The mode of operation of these mixing elements (6) corresponds to that of a pilot stage, whereby the flame stability is increased, while the NOx emissions remain at a low level.

7 Claims, 1 Drawing Sheet

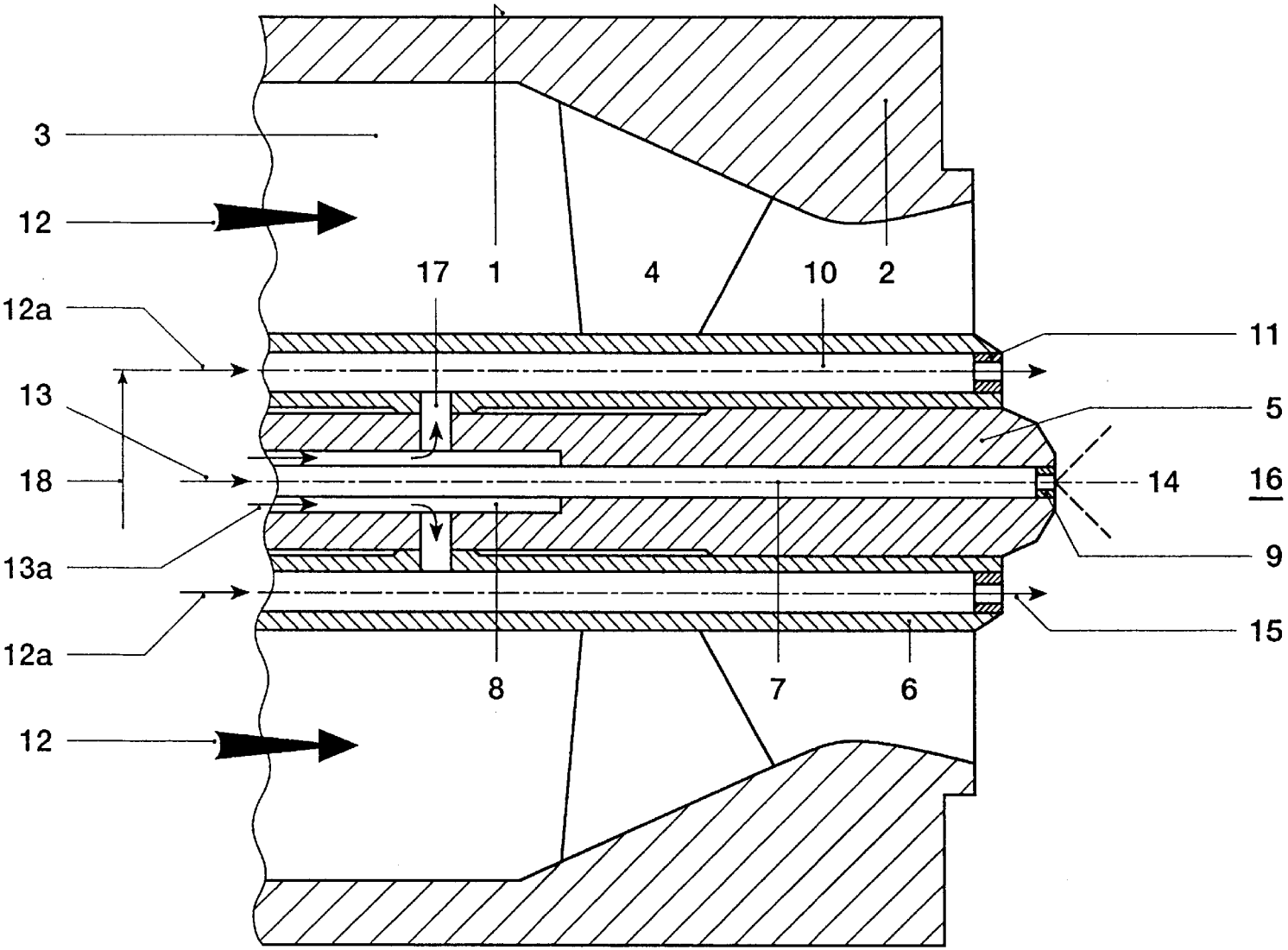
11
5
16
9
15
14
2
10
4
1
17
3
12
12a
13
18
13a
12a
12
6
7
8

BURNER

BACKGROUND OF THE INVENTION

Field of the Invention

The present invention relates to a burner having a fuel lance with airblast fuel atomization.

Discussion of Background

Considered from the point of view of burner development, the airblast fuel atomization is the method which can be realized with the least expense. On account of its insensitivity to geometric changes at the combustion-chamber-side nozzle parts, there is comparatively high reliability under machine conditions. However, on account of the high fuel concentrations in the backflow zone of this burner, relatively high NOx emissions result. On the other hand, cost and efficiency reasons as well as the desire for a simple system without atomization-air compressor mainly require an alternative concept for the oil injection. The pressure atomization would provide an alternative here, which is suitable as far as installation space is concerned. An important question in this connection certainly relates to the optimum spray angle and the optimum oil pressure in the entire operating range between ignition at atmospheric pressure and full load at maximum combustion-chamber pressure, which in the meantime is always greater than 15 bar. A burner operated in such a way is only able to burn gaseous fuels at a low pollution level; liquid fuels can only be burned in a conventional diffusion flame with such a burner, for which reason the nitrogen-oxide emissions have to be reduced by water injection. A considerable problem in this burner consists in the fact that a varying spread and vaporization behavior of the spray as well as a varying atomization quality, which cause the NOx emissions to rise, result during the transition to high pressure. The same can also be found in the transient ranges.

SUMMARY OF THE INVENTION

Accordingly, one object of the invention, as defined in the claims, is to provide in a burner of the type mentioned at the beginning novel measures which are able to maximize the efficiency of the combustion and at the same time minimize the NOx emissions.

According to the invention, the burner is extended in such a way that a number of individual, self-contained mixing elements are arranged concentrically to a central main fuel lance, each mixing element exhibiting the features of a pilot stage provided an appropriate air coefficient is selected. A small portion of the main combustion air is branched off from the main air flow and flows into the said mixing elements, 2–10% of the combustion air being sufficient here in the normal case. Each mixing element includes a fuel injection, the air/fuel mixture formed herein being injected in the region of the plane of the main fuel nozzle into the combustion space of the combustion chamber so that these mixing elements also function as premix burners. In the event of an overload of the combustion-air feed by the mixing elements, the latter deliver virtually only fuel, as is the case at the central main fuel nozzle. This is of advantage in particular during idling and load disconnection in that a separate fuel feed to the machine is no longer necessary, the NOx emissions still remaining at a low level and increased flame stability being produced. Therefore such an extension with the mixing elements according to the invention is able to qualitatively improve the pure diffusion burner, in particular as far as the disadvantages specified are concerned.

Advantageous and expedient further developments of the achievement of the object according to the invention are specified in the further claims.

BRIEF DESCRIPTION OF THE DRAWING

A more complete appreciation of the invention and many of the attendant advantages thereof will be readily obtained as the same becomes better understood by reference to the following detailed description when considered in connection with the accompanying drawing, wherein the single figure shows the end section of a diffusion burner in the region of the combustion space, with a number of mixing elements arranged concentrically relative to a central main fuel lance.

DESCRIPTION OF THE PREFERRED EMBODIMENT

Referring now to the drawing, wherein all features not essential for directly understanding the invention have been omitted and the direction of flow of the media is specified by arrows, the figure shows a burner 1 which is designed above all for diffusion combustion of a liquid fuel. As far as its configuration is concerned, it may be designed as a tubular burner, as the figure shows, or else be in a combination within an annular combustion chamber. The embodiment shown here as a tubular burner merely relates to the end section of the same relative to the combustion space. The overall length of the burner 1 is adapted to the respective thermodynamic conditions and other conditions of the plant. This burner 1 comprises an outer ring 2, the annular air passage 3 which extends into the end region of the burner 1 right up to the point where a number of swirl generators 4 are arranged. The swirl generators 4 cover the entire annular cross section of the air passage 3 and bring about swirling of the air flow, the throughflow cross section continuously decreasing inside this swirling region preferably up to the start of a venturi section. Downstream of the swirl generators 4, the annular throughflow cross section may then preferably be designed as a venturi nozzle up to the end of the burner 1. A central main fuel lance 5 forms the center body of the burner 1. As far as the feeding of the fuel is concerned, this fuel lance may be designed in various ways, it being readily possible to mix the fuel beforehand with another medium inside the main fuel lance 5. Here, the main fuel lance 5 is designed merely with one main fuel passage 7 and one secondary fuel passage 8, the latter being dealt with in more detail further below. A liquid fuel 13 flows through the main fuel passage 7, which liquid fuel 13 initiates diffusion combustion in the combustion space 16 in interdependence with the swirled main combustion air 12 induced by the swirl generators 4. The main fuel passage 7 is equipped at the end with a main fuel nozzle 9 which produces a spray angle 14 specific to the operation. A number of mixing elements 6 which each consist of a mixture passage 10 are arranged relative to the central main fuel lance 5 in such a way as to be distributed concentrically on a pitch circle diameter 18. A secondary combustion air flow 12*a* flowing through these mixing elements 6, the proportion of which secondary combustion air flow 12*a*, as a rule, amounts to 2–10% of all the combustion air available. Each mixing element 6 has at a suitable point at least one transfer passage 17 for introducing a secondary fuel quantity 13*a* from the secondary fuel passage 8 arranged concentrically to the main fuel passage 7. Given a suitable design of the mixing element 6 and its air-inlet geometry as well as the fuel injection, both liquid and gaseous fuels may in fact be used here. If the central main fuel lance 5 is operated with a liquid fuel, the mixing elements are preferably also operated with the same fuel, which offers advantages for the logistics. The air-inlet geometry and the fuel injection into the mixing element 6 are designed to be of such a magnitude that the full combustion-air and fuel quantity respectively which are necessary for assisted operation over the entire load range can be introduced into the mixing elements 6. At full load, the fuel quantities between the central main fuel lance 5 and the mixing element 6 are selected to be approximately proportional to the corresponding air distribution. The combustion-chamber-side discharge of the mixture 15 formed in the mixing element 6 is received by a nozzle 11 which is located approximately in the plane of the nozzle 9 of the central main fuel lance 5.

In principle, the mixing element 6 exhibits the same properties as a pilot stage as long as an appropriate air coefficient is selected. In the event of overload with regard to the combustion-air quantity, the mixing element 6 delivers virtually only fuel, as is also the case at the central main fuel lance 5. This is of particular importance in as much as the requirement profiles with regard to minimized NOx emissions of the assisting flame in the high load range of the combustion chamber as well as with regard to the extremely high stability range of the assisting flame during idling and load disconnection are consequently fulfilled without the need for separate fuel feeds to the combustion chamber 30.

Therefore only the fuel quantity via the central main fuel lance 5 is preferably reduced when the load decreases, in which case a moderate increase in the fuel quantity via the mixing elements 6, within a certain limit with regard to the Nox emissions, is permissible in such a way that an increase in the ignition action is initiated in this configuration.

If combustion which is inadequate on account of the combustion air coefficient takes place via the central main fuel nozzle 9, i.e. if unburned fuel is emitted here, this can be remedied by this fuel being fed to an ever increasing extent only via the mixing elements 6. Since the air coefficient in such a configuration very quickly assumes very small values (<<1) inside the mixing elements 6, and the air flow through the mixture passages 10 is partly blocked as a result of the large fuel quantity, this mode of operation of the pilot stages then does not differ substantially from that of the central main fuel lance 5.

Obviously, numerous modifications and variations of the present invention are possible in light of the above teachings. It is therefore to be understood that, within the scope of the appended claims, the invention may be practiced otherwise than as specifically described herein.

What is claimed as new and desired to be secured by Letters Patent of the United States is:

1. A burner for a heat generator, comprising:

an outer wall defining an axially directed throughflow passage for directing a combustion-air flow to an outlet of the burner, at least one main fuel lance mounted in the throughflow passage and having a fuel duct with a nozzle at the outlet of the burner, a plurality of swirl generator disposed in the throughflow passage in annular manner around the main fuel lance, a plurality of mixing elements disposed between swirl generators, which mixing elements are arranged in a circumferential manner around the main fuel lance, each mixing element having at least one mixture passage with a nozzle at the outlet of the burner, and means for feeding a fuel and a partial combustion-air quantity into the mixture passages of each mixing element.

2. The burner as claimed in claim 1, wherein the outer wall is shaped to narrow at an axial end of the burner so that the throughflow passage for the combustion-air flow forms a venturi nozzle downstream of the swirl generators at the end of the burner.

3. The burner as claimed in claim 1, further comprising means for operating the mixing elements as pilot stages.

4. The burner as claimed in claim 1, further comprising means for operating the main fuel lance as a diffusion stage.

5. The burner as claimed in claim 1, wherein the main fuel lance nozzle is a pressure atomization nozzle.

6. The burner as claimed in claim 1, wherein said means for feeding the partial combustion-air quantity to the mixing elements feeds a quantity amounting to 2–10% of an entire combustion-air flow quantity.

7. The burner as claimed in claim 1, wherein the main fuel lance is arranged centrally relative to the throughflow passage.

* * * * *